United States Patent [19]

Sullivan

[11] Patent Number: 4,862,818

[45] Date of Patent: Sep. 5, 1989

[54] CANOE STABILIZING AND GUIDE MECHANISM

[75] Inventor: H. Frank Sullivan, Libertyville, Ill.

[73] Assignee: Navillus, Inc., Grayslake, Ill.

[21] Appl. No.: 296,925

[22] Filed: Jan. 11, 1989

Related U.S. Application Data

[63] Continuation of Ser. No. 751,800, Jul. 3, 1985, abandoned.

[51] Int. Cl.[4] ..... B63B 39/06

[52] U.S. Cl. ..... 114/126; 114/347; 114/364

[58] Field of Search ..... 440/101, 104, 105; 114/126, 127, 129, 132, 138, 140, 343, 347, 364; 248/641-643, 640

[56] References Cited

U.S. PATENT DOCUMENTS

| | | | |
|---|---|---|---|
| 2,525,933 | 10/1950 | Nantz | 114/364 X |
| 4,512,277 | 4/1985 | Williams | 114/364 |
| 4,595,373 | 6/1986 | Giroux | 440/104 |

FOREIGN PATENT DOCUMENTS

| | | | |
|---|---|---|---|
| 745121 | 5/1933 | France | 114/364 |
| 746858 | 6/1934 | France | 248/640 |
| 1392346 | 8/1964 | France | 114/126 |

*Primary Examiner*—Sherman D. Basinger

*Attorney, Agent, or Firm*—Lockwood, Alex, FitzGibbon & Cummings

[57] ABSTRACT

A canoe stabilizing and guiding mechanism which includes a bracket to which is mounted a vertically depending canoe paddle, the bracket being mounted on a tube for pivoting therewith, the tube extending transversely of a canoe and dimensioned to place the bracket and canoe paddle outboard of the canoe, the tube being provided with quick disconnect attaching plates for releasably engaging the gunwales of a canoe.

6 Claims, 1 Drawing Sheet

CANOE STABILIZING AND GUIDE MECHANISM

This application is a continuation of application Ser. No. 751,800, filed July 3, 1985 and now abandoned.

BACKGROUND OF THE INVENTION

The present invention relates generally to a canoe stabilizing and guiding mechanism of uncomplicated design which may be detachably mounted on a canoe to stabilize and assist in guiding the canoe thereby readily permitting a single operator to paddle the canoe from the conventional stern seat with a minimum of skill and strength.

Numerous devices have been proposed for use with canoes in an effort to overcome the inherent instability of a canoe and the inherent difficulty in single person operation of a canoe. The draft of a canoe is very slight as it is designed to ride high in the water and to be readily manipulated in tight areas such as on rivers and the like to avoid rocks and follow a rather tortuous path. By reason of the shallow draft of the canoe, and the relative high seat to allow unrestricted paddling motion, the same is considerably unstable and in rocky or swift current passages considerable skill is required of the operator or operators to maintain control over the canoe to avoid capsizing and maintain directional control. Again, because of the shallow draft of a canoe, windy conditions will also adversely affect control over the operation of the canoe. Normal operation of a canoe without auxiliary assistance involves at lest one operator in the stern and usually an operator in the bow. The bow operator provides forward force without directional control to any great extent, whereas the stern operator must provide not only forward force but also directional control. As a result the stern operator should preferably be an experienced paddler and normally under such circumstances will use what is recognized as the J-stroke. This particular stroke includes reaching forward with the paddle, digging the paddle into the water, pulling rearwardly with considerable strength and then toward the end of the rearward stroke moving the paddle either outwardly or inwardly in the general configuration of a J. Outward movement of the paddle will steer the bow to the right and inward movement of the paddle at the end of the stroke will steer the bow to the left. This type of stroke makes correction for inherent changes in direction caused not only by the unbalance of forces applied to the canoe by other paddlers but also to compensate for current and wind conditions. This type of stern stroke is designed to permit compensation for direction of forward movement of the canoe without any material interference with the forward momentum of the canoe.

The most common forms of canoe stabilizers and guiding mechanisms used extensively with sailing canoes involve outriggers for stabilization and various forms of centerboards, keels or leeboards mounted on the outrigger or along the side of a canoe as might be preferred. These particular mechanisms depend in the water and are designed to prevent among other things transverse movement of the canoe while it is subjected to forward movement. These mechanisms will resist wind to some extent and while they are capable of providing some degree of stabilization they are not capable of providing guiding action. Rudders are designed for use on canoes but the mounting and operation of such mechanisms changes the entire character of the canoe as normally rudders are used with sailing canoes or engine powered canoes.

The present invention very effectively and inexpensively provides stabilization and adjustable guiding to a canoe to permit a single operator, even a novice, to handle a canoe under what might ordinarily be considered adverse conditions. It may also be used to replace outriggers, centerboards or leeboards for normal paddling or sailing. Basically, the present canoe stabilizing and guiding mechanism includes a bracket mounted outboard of the canoe, which bracket receives a canoe paddle or other suitable form of stabilizer and guide, the canoe paddle being adjustably mounted in the bracket so as to depend therefrom to place the blade of the paddle in the water. The depending canoe paddle provides stability to the canoe by reason of being mounted outboard of the canoe and the paddle may be selectively rotated from one position to another so as to change the direction of the depending blade of the paddle thereby providing guiding action to the canoe. In this manner a stern paddler can operate the canoe without any requisite degree of skill as the stern paddler need merely set the paddle or other form of stabilizer mounted in the bracket in such a manner as to compensate for existing factors affecting the operation of the canoe thereby permitting the stern paddler to merely paddle in a normal inexperienced manner. When fishing from the canoe, the paddle, extending vertically into the water provides a stabilizing effect by counterbalancing against the movement of the fishermen in casting change of position or side-to-side movement caused by wind and wave action. The amount of stabilization imparted to the canoe may be increased or decreased by adjusting the depth to which the paddle extends into the water. The greater the depth of the paddle in the water the greater the stabilizing effect.

SUMMARY OF THE INVENTION

A canoe stabilizing and guiding mechanism includes a bracket means for mounting a vertically depending stabilizer and guide. Canoe attachment means are connected to the bracket means to mount the bracket means outboard of a canoe. The bracket means is designed to receive and releasably hold the depending stabilizer and guide to be adjusted vertically and rotatably to vary the extent to which the stabilizer and guide extends downwardly in the water and to change the direction of the blade of the stabilizer and guide to control its affect on directional movement of a canoe. The bracket means and its attachment means includes an arrangement permitting pivoting of at least the bracket means about a horizontal axis so that the depending stabilizer and guide may be undamaged in the event it strikes an object in the water. When not required for stabilization the paddle may be rotated until it is parallel to the canoe gunwales, completely out of the water and stored in this position. Normal operation of the canoe with the paddle in this position is now possible.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference identify like elements, and in which:

DESCRIPTION OF THE PREFERRED EMBODIMENT

Figures 1, 2, 3, 4, 5:
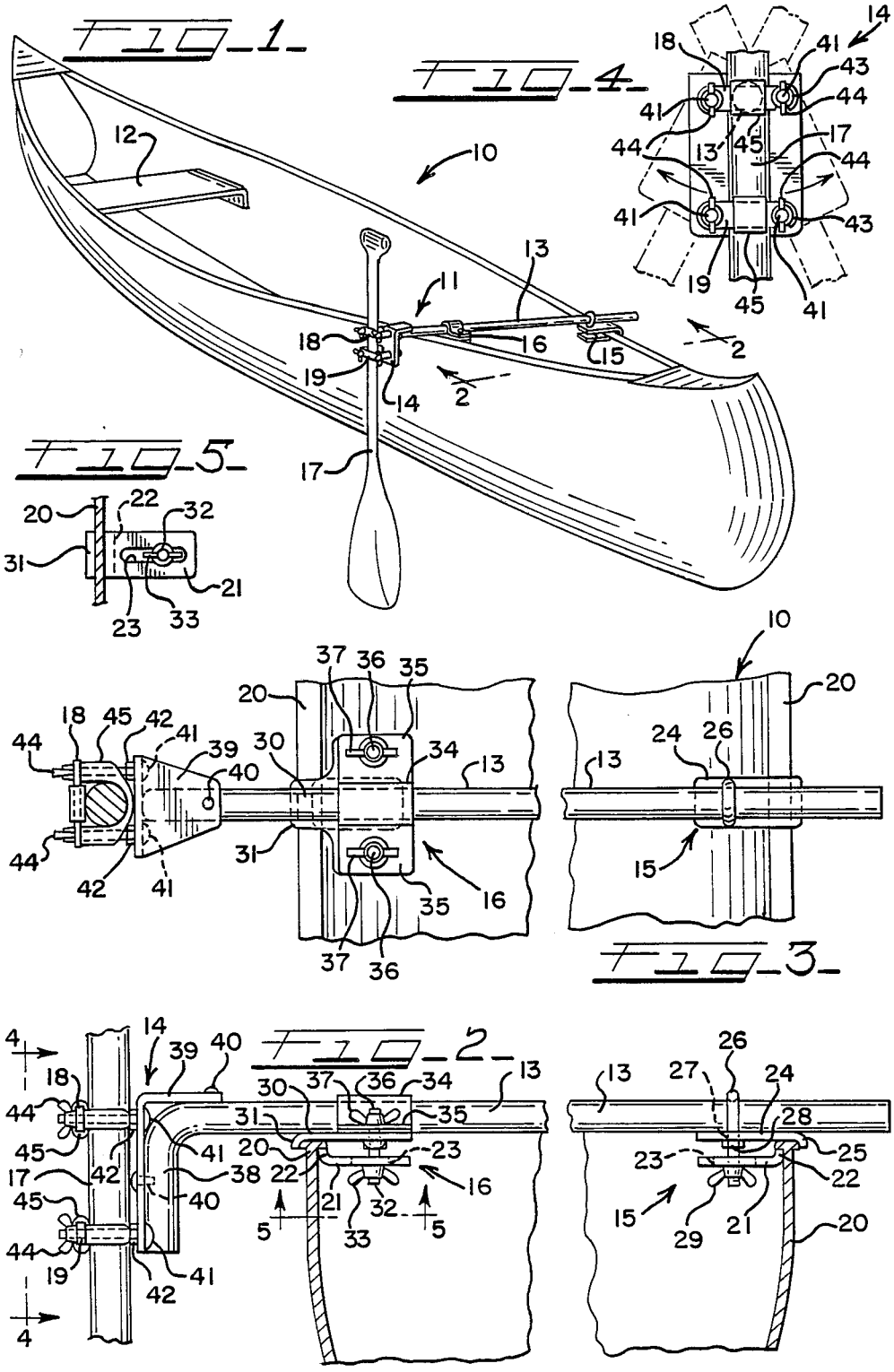
FIG. 1 is a perspective view of a canoe including the stabilizer and guiding mechanism mounted therein accordance with the invention.
FIG. 2 is a partial fragmented cross-sectional view of the canoe of FIG. 1 illustrating the stabilizer and guiding mechanism in front elevation, as viewed along line 2—2 of FIG. 1.
FIG. 3 is a fragmentary top plan view of the stabilizer and guiding mechanism.
FIG. 4 is a fragmentary elevation view of a portion of the stabilizing and guiding mechanism as viewed along line 4—4 in FIG. 2.
FIG. 5 is a fragmentary view of another portion of the mechanism taken along lines 5–5 in FIG. 2.

Referring to the figures, and in particular to FIG. 1, a canoe 10 is illustrated as having mounted thereon the stabilizer and guide mechanism 11 of the present invention. The canoe 10 is of conventional construction including a stern seat 12 for use by an operator in the well known manner. The stabilizer and guide mechanism 11 is mounted toward the bow of the canoe so as to be spaced sufficiently forwardly of the stern seat 12 to be effective in stabilizing and guiding the canoe in conjunction with paddling by the stern operator. As can be readily seen in FIG. 1, the stabilizer and guide mechanism 11 extends transversely of the forward portion of the canoe 10 and generally includes a tube or bar 13 extending transversely of the forward position of the canoe and mounting at an outer end thereof a bracket 14 which is positioned outboard of the canoe. The tube 13 and bracket 14 are attached to the canoe through spaced clamp assemblies 15 and 16 which engage the gunwales of the canoe along top and bottom surfaces thereof to releasably mount the stabilizer and guiding mechanism to the canoe. The bracket 14 is of generally L-shaped configuration with a depending flange on the outer surface thereof including a pair of yokes 18 and 19 designed to releasably clamp the handle of the canoe paddle 17 so that the canoe paddle depends downwardly from the clamping mechanism outboard of the canoe and the blade of the paddle extends into the water for stabilizing and guiding purposes.

FIGS. 2 and 3 illustrate the stabilizer and guiding mechanism in greater detail. As can best be seen in FIG. 2, each clamp assembly 15 and 16 includes a bottom attaching plate 21 of the same construction. A bottom plan view of this plate is shown in FIG. 5 and it can be seen comparing FIGS. 2 and 5 that each plate is flat and at an end thereof is bent into a right angle flange portion 22 and centrally and longitudinally thereof each plate is provided with a slot 23. The right angled end portion 22 of each plate is designed to engage the undersurface of the inward projection of a gunwale 20 of a canoe as best shown in FIG. 2.

Referring to the clamp assembly 15 as best shown in FIGS. 2 and 3, a top attaching plate 24 is provided, such plate being somewhat similar to the bottom attaching plate 21 in that it is a flat plate having at an end thereof a downwardly bent portion in the form a flange 25, the portion of the plate adjacent the flange 25 extending over the top surface of a gunwale 20 with the flange 25 depending downwardly about the top outer surface of the gunwale. Eyebolt 26 receives the far end of the tube 13 therethrough, the relative dimensions of the eyebolt 66 and tube 13 being such that the tube 13 can rotate and move longitudinally within the eyebolt 26. Preferably, the dimensions are such that the fit between these parts is relatively snug as it is preferable not to have any considerable play between the tube 13 and eyebolt 26. The top attaching plate 24 is provided with an aperture 27 therethrough which receives the threaded shank of the eyebolt 26. The top attaching 24 is locked to the eyebolt 26 and in turn the tube 13 is connected to the attaching plate 24 by a locking nut 28. The threaded shank of the eyebolt 26 is received through the slot 23 of the bottom attaching plate 21 and is fastened thereto by a wing nut 29.

With the foregoing parts of the clamp assembly 15, the on end of the stabilizing and guiding mechanism can be readily removably attached to a gunwale of a canoe as best illustrated in FIG. 2. As previously described, the upwardly directed flange 22 of the bottom attaching plate 21 engages the undersurface of an inwardly projecting portion of the gunwale 20 whereas the depending flange 25 of the top attaching plate 24 engages an outer surface of the top portion of the gunwale 20. The wing nut 29 is advanced upwardly along the threaded shank of the eyebolt 26 drawing the two attaching plates 21 and 24 together and clamping the engaged portion of the gunwale between the plates. The clamp assembly 15 is thus readily disengageable without the necessity of using any special tools. This assembly 15 is also slidable along the tube 13 to facilitate mounting and dismounting of the stabilizing and guiding mechanism to a canoe.

Still referring particularly to FIGS. 2 and 3, the clamp assembly 16 includes the bottom attaching plate 21 previously described and a top attaching plate 30 which is a flat plate having the outer end thereof bent in the form of a flange 31 which is designed to engage the outer edge of the top portion of a gunwale 20 similarly as described in connection with top attaching plate 24. Centrally of the top attachment plate 30 a suitable screw 32 is mounted in an opening 23 in the central portion of the plate and depends therefrom. The head of the screw 32 is recessed in an aperture of the top attaching plate 30 and a wing nut 33 completes this sub-assembly to draw the two opposing plates together. The top and bottom attaching plates 30 and 21 of the assembly 16 function in the same manner as previously described in connection with the assembly 15 and are also readily detachable from the gunwale of a canoe without the need of special tools.

The tube 13 is attached to the clamp assembly 16 by a tension plate 34 which can be seen as being in the form of an inverted U. The central portion of the tension plate 34 is shaped to conform to the outer configuration of the tube 13 and to engage the same as will be described. The tension plate 34 includes two projecting side flanges 35 of similar configuration. These flanges extend over the outer portions of the attaching plate 30 and are each apertured to receive a bolt 36 therethrough. The portions of the top attaching plate 30 extending directly below the side flanges 35 of the tension plate 34 are also suitably apertured to receive the bolts 36 therethrough in an upward direction. Wing nuts 37 are received on the bolts 36 to releasably clamp the tension plate 34 toward the top attaching plate 30 and thereby hold the tube 13 in place.

The tube 13 outboard of the tension plate 34 is provided with a right angled downwardly depending portion 38 (FIG. 2). The bracket assembly 14 is mounted to this end of the tube 13 and includes a right angle plate 39 which is fixedly attached to the adJacent end of the tube 13 by suitable rivets 40 or the like. As illustrated in FIGS. 2, 3 and 4, the downwardly depending portion of the plate 39 is provided with four bolts 41 preferably of identical construction. The heads of the bolts are located along the inner surface of the depending portion of the plate 39 and the shanks of the bolts extend through suitable apertures in the plate 39. Lock nuts 42 are threaded on bolts 41 and lock the bolts in place on the depending portion of the bracket plate 39. The bolts 41 are arranged in upper and lower pairs as best illustrated in FIGS. 2 and 4. Between each pair of bolts the handle portion of a canoe paddle 17 is positioned. An upper yoke plate 18 interconnects the two upper bolts as best illustrated in FIG. 4 and a lower yoke plate 19 similarly interconnects the lowermost pair of bolts 41. Each yoke plate is provided with an aperture at one end to receive bolt therethrough and to be pivotal about such bolt. The remaining end of each yoke plate includes an open hook-like portion 43 (FIG. 4) which can be dropped over an adjacent bolt 41. Wing nuts 44 complete the attachment assembly by being received on the outer ends of the bolts 41 to releasably lock the yokes 18 and 19 in canoe paddle handle clamping position. Preferably, the assembly is complete with the provision of cushioning means in the form of rubber tubing pads 45 which suitably surround at least the inner surfaces of the threaded bolts 41, the inner surfaces of the yokes 18 and 19 and the outer surface of the depending flange portion of the bracket plate 39. Such suitable cushioning means protects the handle of the canoe paddle 17 from marring when the same is clamped in the bracket assembly 14.

Ease of attachment and removal of the stabilizer and guiding mechanism is readily apparent from the description given. For example, the canoe paddle 17 can be readily removed from the bracket assembly 14 by loosening the wing nuts 44 and lifting the yokes 18 and 19 to provide a space for the handle of the paddle to be moved outwardly between the pairs of bolts 41. In this respect, and of particular importance to the invention, the wing nuts 44 may be loosened to permit the paddle 17 to be rotated so a to place the blade in various positions. Ordinarily, the blade would not be placed in a position corresponding to the longitudinal axis of the canoe. In order to accommodate a single operator paddling from one side of the canoe and not using the demanding J-stroke, the blade of the paddle 17 would be directed at an angle to adjust for the straight directional paddling of the operator. Still further, in the event of a wind which affects the direction of movement of the canoe, or if a current is also affecting the direction of movement of the canoe, the paddle 17 would be rotated within the bracket assembly 14 so a to adjust the direction of forward movement of the canoe to counteract the adverse conditions. Furthermore, the elevation of the canoe paddle as held by the bracket assembly 14 can be varied so as to adjust the amount of blade of the canoe actually depending into the water. Because of the small draft of a canoe, rocking and tipping is prevalent. The mechanism described will also provide resistance to rocking or tipping similar to the action of a keel or centerboard. The use of a canoe paddle has been described and illustrated because it is the most convenient part of a canoe and due to the design of the subject stabilizer and guiding mechanism it is readily adapted for use therewith.

The tension plate 34 of the invention is an important aspect thereof. As viewed best in FIG. 2, the plate itself snuggly receives the tube 13 and the plate is dimensioned so that the lateral flanges 35 do not bottom out against the top surface of the top attaching plate 30. By reason of this spacing, the wing nuts 37 can be adjusted to vary the tension supplied by the plate 34 against the tube 13. Accordingly, the tension can be adjusted so that the tube 13 can rotate about its main longitudinal axis within the tension plate 34 and the eyebolt 26. This available rotational action is advantageous in the event that the canoe paddle 17 strikes an object under the surface of the water. In order to avoid damage to the canoe paddle 17 or a drastic change in the direction of movement of the canoe by reason of striking a submerged object, the entire stabilizer and guide mechanism can rotate after being subjected to a pre-selected force. For example, as viewed in FIG. 1, clockwise rotation of a canoe paddle upon the blade thereof hitting a submerged object will cause the blade to move rearwardly and upwardly out of the water and over the submerged object. Movement in either clockwise or counterclockwise direction is illustrated in broken lines in FIG. 4.

Though the use of canoe paddle as a stabilizer has been shown and described, it will be appreciated that other stabilizer configurations can be advantageously employed. Similarly, it will be appreciated that solid rather than tubular structural members can be successfully utilized in the invention and that a variety of durable materials can be utilized in its formation.

While a particular embodiment of the invention has been shown and described, it will be obvious to those skilled in the art that changes and modifications may be made therein without departing from the invention in its broader aspects, and, therefore, the aim in the appended claims is to cover all such changes and modifications as fall within the true spirit and scope of the invention.

I claim:

1. A canoe stabilizing and guiding mechanism comprising:

a generally planar bracket for mounting to the shank of a canoe paddle;

attachment means fixedly engaging the gunwales of a canoe for mounting an elongate bracket mounting member thereon;

an elongate bracket mounting member attached to said bracket and oriented generally perpendicularly to the plane thereof, said elongate bracket mounting member being rotatably movable relative to said attachment means and extending from one gunwale to the opposing gunwale;

adjustable tension means for selectively restricting the rotational movement of said elongate bracket mounting member whereby said elongate bracket mounting member resists pivoting until a preselected force is exceeded;

releasable clamping means on said bracket for engaging and clamping the canoe paddle in variable predetermined vertical and rotational positions relative to the canoe;

said attachment means including opposing adjustable clamps for engaging opposed surfaces of a section of at least one gunwale of a canoe and wherein said adjustable tension means includes a stationary support member which supports a portion of said rotatable elongate mounting member;

a friction member mounted on said support member having an arcuate section dimensioned to engage a portion of the circumference of said rotatable elongate mounting member; and adjustment means for adjusting the friction between said friction member and said rotatable elongate mounting member, said support member being one of said opposing adjustable clamps.

2. A canoe stabilizing and guiding mechanism as defined in claim 1, said elongate bracket mounting member being mounted for rotation in said opposing adjustable clamps and having said bracket fixed to said elongate bracket mounting member at one end thereof.

3. A canoe stabilizing and guiding mechanism as defined in claim 2 which further comprises at least one yoke pivotally mounted at one end of said bracket and releasably engagable at the other end thereof with a releasable fastener to releasably hold the shank portion of a canoe paddle with the blade thereof depending downwardly from said bracket.

4. A canoe stabilizing and guiding mechanism comprising:

bracket means for mounting a depending generally planar elongate stabilizer and guide, said bracket means including means for releasably holding said depending generally planar elongate stabilizer and guide, said holding means of said bracket means including at least one yoke pivotally mounted at one end of said bracket means and releasably engagable at the other end thereof with a releasable fastener to releasably hold the handle portion of a canoe paddle with the blade thereof depending downwardly from said bracket means;

canoe attachment means connected to said bracket means to mount said bracket means outboard of a canoe, said canoe attachment means including opposing adjustable clamps for engaging opposed surfaces of a section of at least one gunwale of a canoe; and, means for pivoting said bracket means about a substantially horizontal axis, said pivot means including a rotatable elongate member fixed to said bracket means and mounted for rotation with respect to said canoe, said rotatable elongate member extending along said substantially horizontal axis from said bracket means outboard said canoe to a location between the gunwales of said canoe, said means for pivoting said bracket means about a horizontal axis further including tensioning means for resisting pivoting of said bracket means until a pre-selected force is exceeded, said rotatable elongate member being mounted for rotation in spaced adjustable clamps and having said bracket means fixed to said rotatable elongate member at one end thereof, and said tensioning means forming a part of one of said adjustable clamps.

5. A canoe stabilizing and guiding mechanism as defined in claim 4, wherein said canoe attachment means includes a clamping mechanism mounted on opposing gunwales of said canoe and said rotatable elongate member further extends along said substantially horizontal axis between said bracket means outboard said canoe to said clamping mechanism mounted on the gunwale opposite said bracket means.

6. A canoe stabilizing and guiding mechanism comprising:

bracket means for mounting a substantially vertically depending canoe paddle in a blade down position;

bracket mounting means attached to said bracket means and extending laterally therefrom and at substantially right angles to the intended plane of a canoe paddle mounted to said bracket means, said bracket mounting means including attachment means for fixedly engaging the gunwales of a canoe and a rotatable elongate member fixed to said bracket means, said rotatable elongate member extending from one gunwale to the opposing gunwale and being rotatably movable relative to said attachment means, at least one end of said rotatable elongate member extending exteriorly of said one gunwale and being attached to said bracket means exteriorly of said one gunwale, said attachment means including opposing adjustable clamps for engaging opposed surfaces of a section of at least one gunwale of a canoe, said rotatable elongate member being mounted for rotation in said opposing adjustable clamps;

adjustable tension means forming a part of one of said adjustable clamps for selectively restricting said rotational movement of said rotatable elongate member, said adjustable tension means resisting pivoting of said rotatable elongate member until a pre-selected force is exceeded; and, releasable clamping means forming a part of said bracket means to clamp a canoe paddle in variable predetermined vertical and rotational positions relative to the canoe, said releasable clamping means for said bracket means including at least one yoke pivotally mounted at one end of said bracket means and releasably engagable at the other end thereof with a releasable fastener to releasably hold the handle portion of a canoe paddle with the blade thereof depending downwardly from said bracket means.

* * * * *